United States Patent [19]

Perr

[11] 4,062,332

[45] Dec. 13, 1977

[54] COMPRESSION BRAKE FOR INTERNAL COMBUSTION ENGINE

[75] Inventor: Julius P. Perr, Columbus, Ind.

[73] Assignee: Cummins Engine Company, Inc., Columbus, Ind.

[21] Appl. No.: 635,827

[22] Filed: Nov. 28, 1975

[51] Int. Cl.[2] ..... F02D 9/66

[52] U.S. Cl. ..... 123/97 B; 188/273; 251/282

[58] Field of Search ..... 123/97 B, 107; 188/273; 251/175, 326, 282

[56] References Cited

U.S. PATENT DOCUMENTS

| | | | |
|---|---|---|---|
| 228,821 | 6/1880 | Lewis | 188/273 |
| 413,500 | 10/1889 | Dunbar | 188/273 |
| 1,577,466 | 3/1926 | Hyre | 188/273 |
| 1,752,229 | 3/1930 | Brueckel | 188/273 |
| 2,895,571 | 7/1959 | Hanebeck | 188/273 |

FOREIGN PATENT DOCUMENTS

| | | | |
|---|---|---|---|
| 230,876 | 12/1959 | Australia | 188/273 |

*Primary Examiner*—Charles J. Myhre
*Assistant Examiner*—Ira S. Lazarus
*Attorney, Agent, or Firm*—Gary M. Gron; Robert T. Ruff

[57] ABSTRACT

The disclosure illustrates a gate type valve which is actuated to block off the exhaust system of an internal combustion engine thereby creating a back pressure which retards rotation of the engine. The gate valve has a series of ports which are selectively uncovered by appropriate inputs to the valve actuator to minimize force requirements when the valve is opened and to limit the amount of engine valve float at relatively high R.P.M.

8 Claims, 3 Drawing Figures

FIG 2
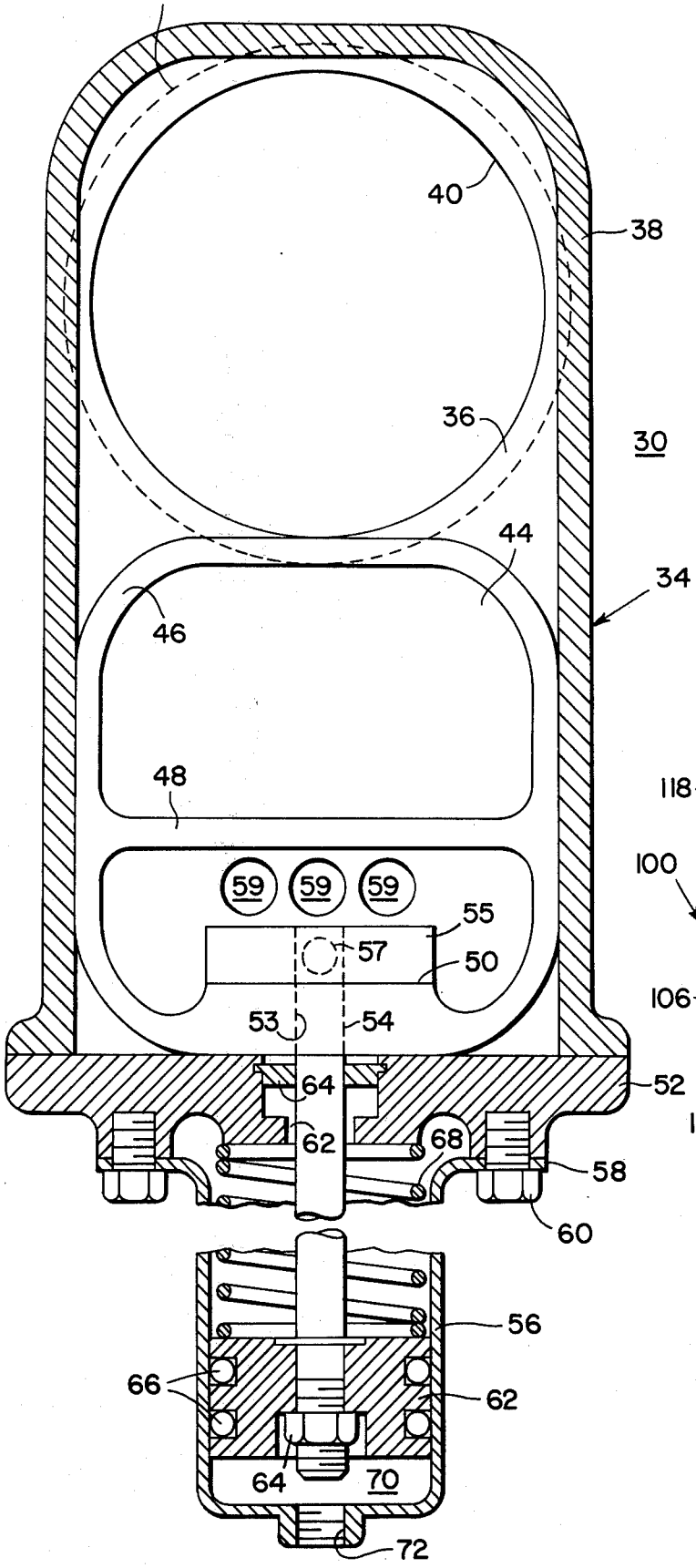
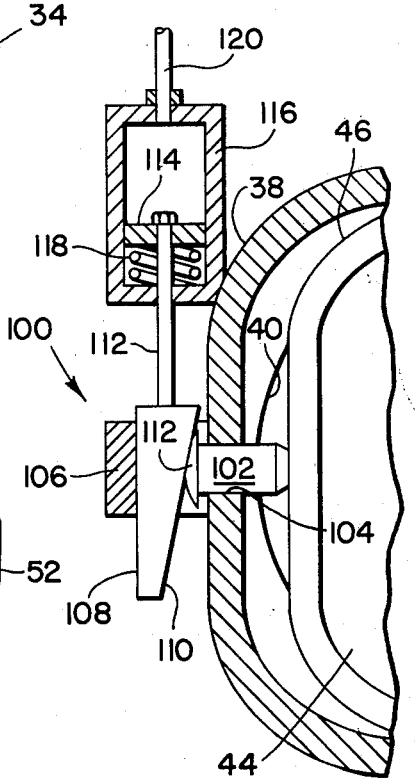
FIG 3

COMPRESSION BRAKE FOR INTERNAL COMBUSTION ENGINE

The present invention relates to systems which convert an internal combustion engine into a braking unit during certain periods of operation.

The compression ignition engine, commonly known as the diesel engine, has been in use in powering heavy duty trucks for a substantial portion of this century. The diesel engine, unlike the spark ignition engine, has no inherent braking effect when the engine throttle is returned to an idle position. The reason for this is that the spark ignition engine has a throttling effect in its carburetor when the throttle is returned to idle. This makes the engine act as a vacuum pump to resist rotation. The diesel engine has no such throttling action because the intake is always unrestricted and engine power is simply controlled by the quantity of fuel delivered.

The solution to this problem has taken many forms. One of them comprises the selective blocking of the engine exhaust system to convert the engine into a pump. Two such examples of this type of brake may be found in the U.S. Pat. to Hyre No. 1,577,466 and Brueckel U.S. Pat. No. 1,752,229. Both of these patents disclose gate type valves adapted to selectively block flow in the exhaust system of an internal combustion engine when braking is desired. During this condition no fuel is supplied to the engine and as a result the air taken in on the intake sroke is compressed, expanded and then pumped into the exhaust system during the exhaust stroke. Since the exhaust system essentially is a closed chamber, the pressure rises until it exerts a force on the engine exhaust valve which exceeds the spring force tending to hold the valve closed. The valve floating during this condition then regulates the pressure level imposed by the brake which is used to retard the rotation of the engine. The work expended in pumping the gases from the engine into the blocked exhaust system thus is the retarding force.

With the above systems several problems can arise. The first problem is that when the valve is in its closed position the pressure on its upstream face can rise to over 50 psi. When this pressure is applied over the large contact area normally found in a gate valve, the frictional forces holding it in that position are substantial. This necessitates a rather large force to displace the valve to its open position. Furthermore it tends to retard the movement of the valve from its closed to open position. It is imperative that the brake be disengaged quickly to permit application of power. Another problem arises when a vehicle is going down a steep hill carrying a substantial load. In this case the vehicle weight may push it at such a rate that the engine R.P.M. climbs to overspeed condition. At this point the valves are floating and the combination of the floating and the overspeeding condition may be detrimental to extended valve life.

The above sets of problems are solved in one aspect of the invention by a compression brake in which a valve element is displaceable in a housing between a position blocking flow through the exhaust system of an engine, and another permitting free flow. A pilot valve system responsive to an element which displaces the valve element opens a flow passage substantially smaller than the main flow path through the housing during certain conditions to reduce the back pressure upstream of the valve element.

The above and other related features of the present invention will be apparent from a reading of the following description of the disclosure shown in the accompanying drawings and the novelty thereof pointed out in the appended claims.

In the drawings:

FIG. 2 is a greatly enlarged longitudinal view of the compression brake of FIG. 1 taken on lines 2—2 of FIG. 1.

FIG. 3 is an enlarged fragmentary view of a compression brake employing an alternative embodiment of the present invention.

Figure 1:
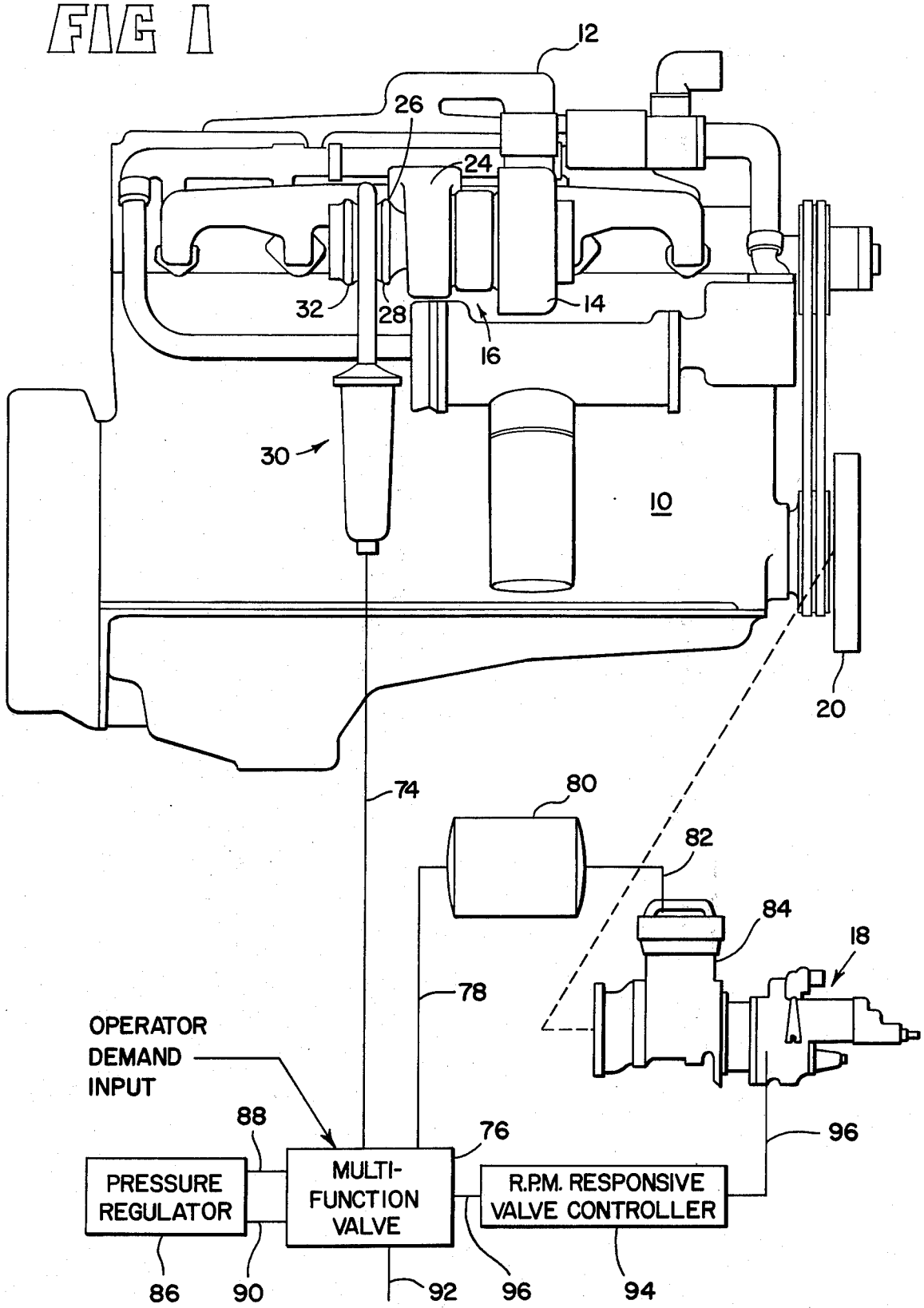
FIG. 1 is an external view of a compression brake embodying the present invention along with a simplified representation of an internal combustion engine with which it is used.

FIG. 1 illustrates an internal combustion engine 10 of the diesel engine type. The engine is a reciprocating 4-stroke in-line engine. The details of its operation are so well known by those skilled in the art that they need not be repeated for a complete understanding of the present invention. However, it is sufficient to point out that the engine has a compression stroke during which air is drawing from an intake manifold 12 past an intake valve by a piston. This air may be prepressurized by the compressor 14 of a turbocharger assembly 16. This air is then compressed by an upward stroke of the piston. At or near the top of the compression stroke metered quantities of fuel are injected by unit injectors (not shown) for each cylinder. Fuel for these injectors is supplied by a fuel system 18 preferably employing the principles of operation outlined in U.S. Pat. No. 3,159,152, of common assignment with the present invention. The injection of the fuel creates a combustible mixture which is ignited by the heat of the compressed gases. This produces a power stroke which forces the piston down and imparts rotation to engine output shaft 20. Subsequent to this stroke the engine exhaust valve opens and the piston displaces the spent products of combustion into an exhaust manifold 22. This manifold may discharge to a centripetal turbine 24 which is connected to drive the compressor 14 of the turbine 16. The exhaust duct 26 of the turbine 24 extends to a mounting flange 28 on a compression brake assembly 30. An additional mounting flange 32 on the compression brake assembly 30 provides the connection to the normal exhaust system found in a vehicle.

Referring to FIG. 2 the valve assembly 30 comprises an elongated housing 34 consisting of end walls 36 and side edges 38. These elements may be fabricated from individual components or may be cast as an integral unit. Openings 40 are provided in end walls 36 in line with the mounting flanges 28 and 32. Housing 34 defines a channel 42 in which a gate valve element 44 is displaceable. Gate valve 44 has a rim 46 to minimize the surface contact area between the gate valve 44 and end walls 36. Gate valve 44 also has an interconnecting rib which together with extension 50 of rim 46 form spaced abutments. There is sufficient elongation in housing 34 to enable the gate valve 44 to be displaced from a first position in which it blocks opening 40 to the illustrated second position, wherein it abuts an end cap 52 of housing 34, in which it permits free flow of exhaust gases through that opening. It can be seen that the gate valve 44 is displaceable substantially perpendicular to the flow through opening 40.

Gate valve 44 is displaced between these positions by a shaft 54 extending through hole 53 in rim 46. Shaft 54 is connected to gate valve 44 by a plate 55 connected to the end of shaft 54 by pin 57. As such, plate 55 is trapped between rib 48 and extension 50 of rim 46 so that there is lost motion between the shaft 54 and gate valve 44. A plurality of ports 59 are provided in gate valve 44 so that they are covered to prevent flow when plate 55 is against rib 48 and they are open to permit flow when plate 55 is against extension 50.

Shaft 54 extends into a cylindrical housing 56 secured to end cap 52 along a flange 58 by screws 60. Shaft 54 extends through opening 62 in end cap 52 which contains a seal 64 to prevent flow of exhaust gases into housing 56. To one end of shaft 54 is connected to a piston 62 by means of a nut 64 threaded onto its end. Appropriate circumferential seals 66 on piston 62 prevent flow of air across piston 62. A spring 68 acts on end cap 52 and on one face of piston 62 to urge the shaft 54 toward the second position of gate valve 44. A chamber 70 defined in part by the opposite face of piston 62 is pressurized by compressed air via inlet 72.

Inlet 72 is supplied with pressurized air by a line 74 extending to a multi function valve 76. Compressed air is supplied to valve 76 by a line 78 extending to a storage tank 80 fed by line 82 from an engine driven air compressor 84. It should be noted that air tank 80 and pump 84 are standard equipment on vehicles which utilize an air brake system to retard movement of the vehicle wheels. Generally speaking the output of compressor 84 is regulated to a given level, for example 100 psi.

The multi function valve 76 has one flow path in which a pressure regulator 86 is connected in series between lines 74 and 78 through the use of interconnecting lines 88 and 90. Multi function valve 76 also has an exhaust line 92 open to atmosphere. Multi function valve 76 receives a number of input signals to vary its function. These may take the form of the illustrated operator demand input and a signal from an R.P.M. responsive valve controller 94 via line 96. Valve controller 94 may receive an R.P.M. input signal from fuel system 18 through line 96.

The various functions of the multi function valve 76 may be illustrated as follows:

| Condition | Valve Function |
|---|---|
| I | Line 78 connects directly to line 74. |
| II | Line 78 is blocked and line 74 connected to line 92. |
| III | Line 78 connects to line 90; line 88 connects to line 74. |

The change in condition from I to II takes place in response to operator demand. The change from condition I to III takes place in response to the engine R.P.M. exceeding a predetermined maximum level. The pressure regulator 86, multi function valve 76 and the R.P.M. responsive valve controller 94 may take different forms depending upon whether the control system would be pneumatic, electric, hydraulic or a combination of these systems. By way of example, but in no way limiting the invention's scope, the multi function valve can be a four position solenoid valve which receives electrical impulses from an operator demand switch to place valve between conditions I and II. The R.P.M. responsive valve controller can be an R.P.M. responsive switch located on the fuel control 18 to change a circuit condition when the engine R.P.M. is above a particular level. An example of such a switch is the one manufactured by Pierce Governor Company, Upland, Ind. 46989. It should be noted that the valve 76 would be set up to cause the R.P.M. signal to always override the operator demand input signal and change the condition of the valve from I to III. It should also be noted that the valve would be set up so that an operator input placing it in condition II can not be overridden by the R.P.M. rsponsive valve controller to place it in condition III.

In operation the compression brake is in the position illustrated in FIG. 2 and in this position the valve is in condition II. When engine braking is desired fuel flow is terminated and the valve 76 changed to condition I in which the full air pressure is connected to chamber 70. This displaces piston 62 to cause plate 55 to abut rib 48 and cover ports 59. The gate valve 44 then is displaced so that it covers opening 40 to block exhaust flow from engine 10. Because the engine exhaust flow is blocked its rotation is retarded thus making it act as a brake. During the braking condition the vehicle inertia may cause the engine to speed to a detrimental R.P.M. The valve controller 94 is made responsive to an undesired R.P.M. condition to change the condition of valve 76 to III during which the pressure regulator 86 controls the pressure to chamber 70. This pressure is set at a level which is a predetermined amount less than the full actuating pressure. It is set so that plate 55 will be displaced by spring 68 against extention 50 to uncover ports 59 but not low enough to cause the spring 68 to displace the entire gate valve 44 to its open position. In this condition exhaust flow from the engine is permitted to pass through ports 59 which are sized to give a predetermined reduction in back pressure ahead of the gate valve 44. As is apparent from the drawing these ports are substantially smaller in area than the area of opening 40. Thus the amount of back pressure imposed on the engine is reduced to tend to minimize the amount of valve float that takes place and thus prolong its life. During this condition it is simply necessary to use the existing vehicle air brake system to supplement the braking effect of the compression brake 30. When the engine R.P.M. is reduced to below the predetermined level, valve controller 94 changes the condition of valve 76 to I during which the full pressure from tank 80 is applied to chamber 70 thus covering ports 59 and maintaining full braking effort.

When it is desired to remove the braking action the valve is placed in condition II wherein air pressure from tank 80 is blocked and line 74 opened to atmosphere. This immediately drops the pressure in chamber 70 to permit spring 68 to displace bar 55 against stop 50. As described above the back pressure ahead of the valve 44 is reduced because of flow through ports 59. The net effect of this is to reduce the pressure that forces gate valve 44 against end wall 36. This greatly reduces the friction forces tending to hold the gate valve 44 in its closed position. As a result the spring 68 quickly displaces gate valve 44 to the illustrated open position permitting free flow of exhaust gases from the engine 10. The provision of the valve assembly comprising the ports 59 and plate 55 greatly reduces the time needed to open the compression brake 30. This has significant benefits in vehicle performance when an operator desires immediate initiation of power after braking.

Referring to FIG. 3 there is shown an alternative embodiment to the compression brake of FIGS. 1 and 2. This system permits the gate valve 44 to substantially but not completely close opening 40 when it is in its first position. This feature may be employed to give a variable level of braking depending upon whether a vehicle is heavily or lightly loaded. The system comprises a plunger 102 extending through an opening 104 in edge 38. A forked support 106 connected to edge 38 receives a wedge shaped actuating element 108 having an inclined surface 110 acting on the head 112 of plunger 102. Element 108 is connected to a shaft 112 extending to a piston 114 in a cylindrical actuator chamber 116. A spring 118 in chamber 116 urges element 108 towards the position in which plunger 102 can be displaced away from opening 40. A line 120 connected to a source of pressure permits piston 114 to be displaced against spring 118 thereby displacing plunger 102 to the illustrated position in which it prevents complete closing of opening 40 by gate valve 44.

In operation chamber 116 is de-pressurized to permit complete closing of opening 40, however, during light load operation, chamber 116 is pressurized to prevent complete closing of opening 40. This permits flow of gases across the valve thereby lessening the braking effectiveness to make the system easier to control under partial load conditions.

The compression brake described above offers significant increases in performance over existing units. It automatically prevents excessive back pressure under overspeed conditions and has an extremely fast response time from the closed to the open condition.

While several preferred embodiments of the present invention have been described it should be apparent to those skilled in the art that it may be practiced in other forms without departing from its spirit and scope.

Having thus described the invention what is claimed as novel and desired to be secured by letters patent of the United States is:

1. A compression brake for a reciprocating rotary output multistroke internal combustion engine which pumps gas from a combustion chamber through an exhaust system during one of said strokes, said brake comprising:

a housing interposed in said exhaust system and having a flow path therethrough for gases of said engine;

a gate valve element in said housing displaceable in a direction substantially perpendicular to the direction of gas flow through said housing between a first position in which it blocks flow through said housing thereby creating a substantial back pressure on said engine for retarding its rotation and a second position in which flow is freely permitted;

a movable element for displacing said valve element between said first and second positions;

said gate valve element having at least one port therethrough, said port being exposed to said flow path when said valve element is in said first position, said port having a flow area substantially less than that for the housing flow path, displaceable valve means actuated by said movable element to block flow through said port when said element displaces said valve element toward said first position and to permit flow through said port prior to displacement of said gate valve element toward said second position thereby initially reducing back pressure upstream of said valve element sufficiently to minimize friction forces holding said valve in its first position.

2. Apparatus as in claim 1 wherein;

said movable element comprises a shaft displaceable in said housing in a direction parallel to the path of movement of said gate valve; and, said valve means comprises a pair of spaced opposing abutments on said gate valve adjacent said port and a valve plate connected to said rod and positioned between said abutments, said abutments being positioned so that displacement of said shaft toward first position blocks flow through said ports and dislacement toward said second position initially opens said port to permit flow therethrough before said gate valve element is displaced toward said second position.

3. Apparatus as in claim 1 further comprising an actuator comprising a cylinder in which a piston is displaceable, said piston being connected to said movable element, and a means for supplying air under pressure for displacing said piston in a direction towards said first position.

4. Apparatus as in claim 3 wherein said actuator comprises a spring biasing said piston in the direction displacing said valve element toward said second position whereby said cylinder is pressurized to displace said valve element toward said first position and de-pressurized to place said valve element in said second position.

5. Apparatus as in claim 1 further comprising means for forming an adjustable stop which permits said valve element to selectively fully block flow through said housing or partially block flow therethrough, thereby providing a variable retarding effect.

6. Apparatus as in claim 5 wherein:

said adjustable stop means comprises an abutment element displaceable in said housing in a direction parallel to the direction of movement to said gate valve and between two positions, the first of which permits said gate valve to fully block flow through said housing and the second of which maintains said gate valve in a partially closed position, said adjustable stop means also comprising a wedge shaped element displaceable in a direction perpendicular to the direction of displacement of said abutment element for displacing it between said two positions, and means for displacing said wedge shaped element.

7. Apparatus as in claim 1 further comprising:

means for actuating said movable element between three positions, the first placing said valve element in said first position, the second placing said valve element in said second position; and the third uncovering said port;

operator responsive means for displacing said movable element between said first and second positions; and means responsive to engine rotation above a predetermined rate to displace said movable element from its first position to its third position.

8. Apparatus as in claim 7 wherein:

said actuating means comprises: a cylinder having a piston therein connected to said displaceable element; a spring biasing said piston to said second piston; and means for supplying pressurized fluid at a first level;

said operator responsive means and said engine rotation responsive means comprise;

a pressure regulator for regulating fluid pressure to a predetermined second lever lower than said first level;

a valve connected to said pressurized fluid supply means, said cylinder, said pressure regulator and to the atmosphere, said valve having three functional conditions, the first of which connects said pressurized fluid supply means directly to said cylinder, the second of which blocks supply of pressurized fluid to said cylinder and connects said cylinder to atmosphere, and the third of which connects said pressure regulator in series between said pressurized fluid supply means and said cylinder, said valve being responsive to operator demand to be placed in said first and second conditions;

means responsive to said predetermined engine rotational rate to place said valve element from said first to said third condition.

* * * * *